United States Patent [19]

Key

[11] 4,183,610

[45] Jan. 15, 1980

[54] ELECTRICAL CONNECTION APPARATUS

[75] Inventor: Edward H. Key, Wheaton, Ill.

[73] Assignee: TRW Inc., Elk Grove Village, Ill.

[21] Appl. No.: 938,760

[22] Filed: Sep. 1, 1978

Related U.S. Application Data

[63] Continuation of Ser. No. 759,128, Jan. 13, 1977, abandoned.

[51] Int. Cl.[2] ..... H01R 9/12

[52] U.S. Cl. ..... 339/221 R; 339/17 C

[58] Field of Search ..... 339/17 C, 17 F, 221 R, 339/220 R

[56] References Cited

U.S. PATENT DOCUMENTS

| | | | |
|---|---|---|---|
| 3,444,504 | 5/1969 | Lynch | 339/221 R |
| 3,783,433 | 1/1974 | Kurtz | 339/17 C |
| 3,997,229 | 12/1976 | Narozny | 339/17 F |
| 4,017,143 | 4/1977 | Knowles | 339/221 R |

*Primary Examiner*—E. F. Desmond

*Attorney, Agent, or Firm*—Neuman, Williams, Anderson & Olson

[57] ABSTRACT

Press-fit contact pins are disclosed which are adapted for mating with various shrouds and mounting boards. Each of the press-fit contact pins includes a press-fit section comprising, in cross-section, an open, curved or arcuate segment, generally resembling a "C"-shape. The dimensioning of the "C"-shaped press-fit section and the ductility-elasticity of the material from which it is formed are such that, when the pin is inserted into any one of a number of holes in a mounting board of a wide range of sizes, the "C"-shaped press-fit section undergoes plastic deformation in a substantial portion thereof.

24 Claims, 7 Drawing Figures

ELECTRICAL CONNECTION APPARATUS

This is a continuation of application Ser. No. 759,128 filed Jan. 13, 1977, now abandoned.

This invention relates to electrical connection apparatus, and, more particularly, to press-fit contact pins for use in circuit boards, backplanes, panels and other mounting board assemblies.

In the modern mounting board art a number of small contact receiving holes on a mounting board may be located within a small area. It is generally envisioned that a contact pin or the like will extend through each hole and make electrical connections with predetermined electrical components and/or the board itself. Because of the proximity of the board holes and therefore the contact pins, it is desirable to secure the pins to the mounting board without the use of external anchoring means. This has been most frequently accomplished with press-fit contact pins. Such pins have a press-fit section which is collapsibly inserted into the mounting board hole to exert a radial force on the portion of the board defining the hole. Frictional interaction between the press-fit section and the portion of the board defining the hole translates such radial force into a push-out force which retains the pin within the hole until a force exceeding such push-out force is applied to the pin. It is also highly desirable that a given press-fit pin, when used in holes within a wide range of sizes, be able to provide predetermined, substantially uniform, retention forces and positive internal contact over a large surface area without excessive damage to the hole or the conductive material which may line the hole.

Press-fit contact pins having solid, rectangular press-fit sections have been in common use for many years in the United States. The inherent problems of such pins have long been recognized, particularly that of the withstand the rigors of wire-wrapping and handling without requiring excessive push-in force, and obviate the need for specially sized replacement pins and reflow soldering.

Various contact pins, having press-fit sections departing from the traditional, solid, rectangular press-fit section, have been proposed. By way of example, two of such pins are discussed by P. J. Tamburro of Bell Laboratories, Whippany, N.J., in his paper, "*RELIABILITY OF PRESS-FIT PINS IN PRINTED WIRING BOARDS.*" Such pins have not been entirely efficacious in providing the aforestated desired operating capabilities, however. Particularly, such pins are not able to operate in mounting board holes with large tolerances, e.g., in 0.041" nominal holes with ±0.005" tolerance. Moreover, such pins have necessitated the sacrifice of the advantages of simplicity and low initial cost.

Accordingly, it is an object of this invention to provide an improved, low cost, and simplified press-fit contact pin.

It is another object of this invention to provide a press-fit contact pin which is capable of providing, when inserted into holes within a wide range of sizes, predetermined, substantially uniform, retention forces and positive, internal contact over a large surface area without excessive damage to the hole or the conductive material which may line the hole.

It is a further object of this invention to provide a press-fit contact pin which is capable of providing the aforestated desired operating capabilities.

These objects are achieved by a press-fit contact pin according to this invention having a press-fit section which, in cross-section, is an open, curved or arcuate segment, generally resembling a "C"-shape. The "C"-shape has smooth, continuous inner and outer curved surfaces and the ends of the "C"-shape do not abut, either before or after insertion into a mounting board board holes and with a shroud slidably mounted thereon;

Figure 3:
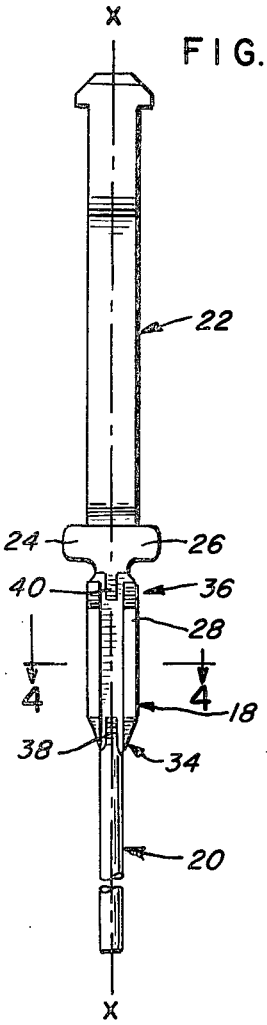
FIG. 3 is a front elevation view of one of the contact pins shown in FIG. 1.
Figure 1:
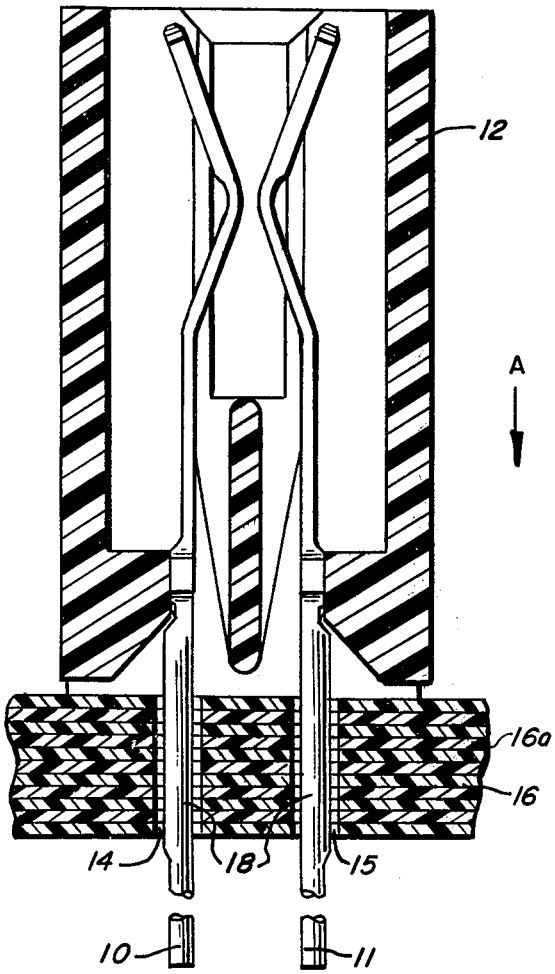
Figure 4:
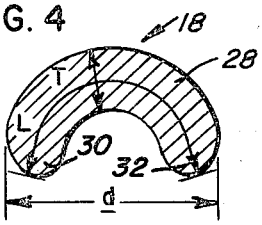
Figure 6:
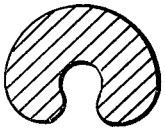
Figure 5:
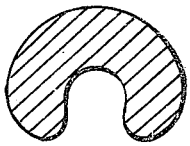
Figure 7:
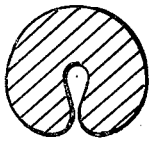

FIG. 4 is an enlarged sectional view of the press-fit section of one of the contact pins shown in FIG. 1, taken along line 4—4 of FIG. 3, prior to insertion into a mounting board hole; and FIGS. 5–7 are enlarged sectional views of the press-fit section of one of the contact pins shown in FIG. 1, taken along line 4—4 of FIG. 3, showing the configuration of the press-fit section when it is inserted into a maximum size mounting board hole, a nominal size mounting board hole, and a minimum size mounting board hole, respectively.

While the invention will be described in connection with a particular embodiment, it will be understood that it is not intended to limit the invention to that embodiment. On the contrary, it is intended to cover all alternatives, modifications and equivalents as may be included within the spirit and scope of the invention as defined by the appended claims.

Turning now to the drawings and principally to FIG. 1, contact pins 10 and 11 embodying principles of this invention are illustrated encompassed by a shroud 12 and with the pins engaged in circuit board holes 14 and 15 in a printed circuit board 16. The pins 10 and 11 are inserted in the direction A through the circuit board holes 14 and 15. Each contact pin 10 and 11 is mounted on the board 16 by frictional engagement of a press-fit section 18 with a portion of the board defining the respective hole. The press-fit sections 18 simultaneously establish electrical contact with each conductive circuit element 16*a* which has a portion exposed at the respective hole. The shroud 12 slides over the contact pins in the direction A and is retained by an interference fit with the contact pins 10 and 11.

The mounting arrangement described above is particularly suited for use in circuit boards and in nonconductive mounting boards. However, in some applications, such as metal back panels, the mounting board may be formed of a conductive material such that the contact pins should not be placed in direct contact with the board. In such applications, the shroud 12 may include a hollow cylindrical boss (not shown) which is designed to fit closely within a mounting board hole and to insulate the press-fit section 18 of a pin which extends through the respective boss; the press-fit section of the pin having a press-fit with the boss, to securely press the boss against the portion of the board defining the hole and thereby secure the shroud and pin on the board.

In the interest of concise description, and since numerous shrouds and mounting boards are well known in the art and may be employed without departing from the nature and scope of the invention, they are not described in greater detail herein.

Figure 2:
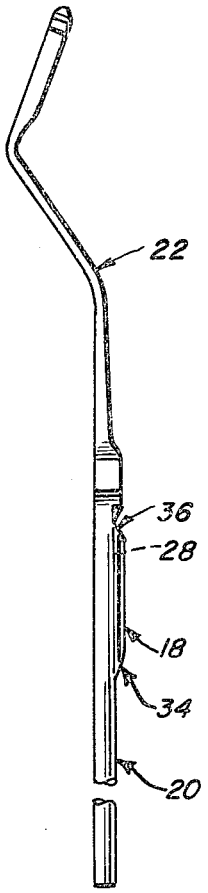
FIG. 2 is a side elevation view of one of the contact pins shown in FIG. 1.

Turning to FIGS. 2 and 3, each contact pin includes primarily three portions, namely a press-fit section 18, a first contact portion 20 joined to one end of the press-fit section 18, and a second contact portion 22 joined to the distal end of the press-fit section 18. The first contact portion 20 is adapted to be positioned through the circuit board holes 14 and 15 and to extend to the opposite side of the board 16. When in place, the portion 20 thus is positioned for electrical contact with any desired electrical component. The illustrated portion 20 is a plain shank such as is used for wire-wrap attachment for an electrical conductor. The second contact portion 22 is adapted to be positioned above the board 16 and within the shroud 12 for mating with a contact or conductor of another electrical component. Where the portion 20 joins the press-fit section 18, two shoulders 24 and 26 extend substantially perpendicularly from axis X—X of the pin. The push-in force necessary to insert the pin within a hole is applied to such shoulders 24 and 26. When in place, each portion 22 of the pins 10 and 11 is inclined toward the other for resiliently engaging a mating contact element (not shown) that may be inserted therebetween. The illustrated portion 22 is a cantilevered contact beam.

It should be understood that a variety of first and second contact portion configurations may be employed in the contact pins without deviating from the scope of this invention.

The press-fit section 18 of each pin 10 and 11 comprises, in cross-section, as seen in FIG. 4, an open, curved or arcuate segment 28, generally resembling a "C"-shape, having smooth, continuous inner and outer curved surfaces. The dimensioning of the "C"-shaped cross-section 28 and the ductibility-elasticity of the material from which it is formed are important in achieving the desirable operating capabilities of this invention. More particularly, in accordance with this invention, the configuration, relative dimensions and ductibility-elasticity of the "C"-shaped design are selected to provide a press-fit section 18 which, when inserted into holes within a wide range of sizes, will be radially compressed and deformed to operate within the plastic deformation range of the material to provide predetermined, substantially uniform, retention forces and to provide positive, internal contact over a large surface area without excessive damage to the hole or to conductive material which may line the hole.

Specifically, the diameter d, thickness T and length L of the open, curved or arcuate segment comprising the "C"-shaped cross-section, and the yield stress of the material from which the "C"-shaped cross-section is formed, are such that when the "C"-shaped cross-section 28 is inserted into holes within a wide range of sizes, the stress in the "C"-shaped cross-section will exceed the yield stress of such material and the "C"-shaped cross-section will undergo inelastic or plastic deformation. The smooth, continuous inner and outer curved surfaces of the "C"-shaped cross-section insure that such stress is not confined to a particular portion of the "C"-shaped cross-section. Rather, such stress is distributed throughout the entire "C"-shaped cross-section. That is to say, a substantial portion of the "C"-shaped cross-section 28 will undergo inelastic or plastic deformation when the "C"-shaped cross-section is inserted into such holes.

In the illustrative embodiment, the inner and outer surfaces of the "C"-shaped cross-section are disposed such that the "C"-shaped cross-section has a substantially uniform thickness. Other configurations of the "C"-shaped cross-section may be employed without departing from the scope of this invention, so long as the inner and outer surfaces of the "C"-shaped cross-section are smooth, continuous curves. Thus, for example, in accordance with known tapered beam loading principles, the "C"-shaped cross-section may be tapered at its ends.

The retention forces developed upon insertion of the "C"-shaped cross-section 28 into such holes will, because of the plastic deformation of the "C"-shaped cross-section, be substantially uniform. Thus, if the pin is inserted into holes having different diameters, e.g., a maximum hole and a minimum hole, the "C"-shaped cross-section is deflected beyond its elastic range in each case and a nearly equal amount of force will be exerted by the "C"-shaped cross-section against the portions of the board.

Moreover, the diameter d, thickness T and length L of the "C"-shaped cross-section 28 are such that, upon insertion of the "C"-shaped cross-section into holes within a wide range of sizes, a maximum amount of stressed material is provided in such holes. Such maximum amount of material provides a large surface area of contact between the press-fit section and such holes, and provides for good stress distribution within the "C"-shaped cross-section such that a desired push-out force may be achieved and the press-fit section will operate in a minimum hole without requiring the material in the press-fit section to operate near a failure stress.

The present invention is intended to include press-fit pins having "C"-shaped cross-sections where the ratio of the thickness T to the diameter d is greater than 1:5, and the ratio of the thickness T to the length L is greater than 1:9.

The ends 30 and 32 of the "C"-shaped cross-section 28 are rounded to alleviate the hazard of damage to the integrity of the mounting board hole and of rupturing of any conductive material which may line the hole, upon insertion of the pin.

The material making up the press-fit section preferably has a high initial stiffness to provide desired retention force upon undergoing minimum displacement required for insertion of the "C"-shaped cross-section into a maximum hole. Moreover, the material preferably is able to withstand severe plastic deformation upon undergoing maximum displacement required for insertion of the "C"-shaped cross-section into a minimum hole, without approaching failure.

In addition to the material and dimensioning of the "C"-shaped cross-section, the transition areas 34 and 36 are important to achieving the desired operating capabilities in the illustrated embodiment. The lower transition area 34 between the press-fit section 18 and the first contact portion 20 must be strong enough to withstand the rigors of wire-wrapping and handling. The lower transition area 34 must not affect the force characteristics of the press-fit section and must be capable of slipping through a minimum hole without excessively damaging the integrity of the hole or rupturing the conductive material which may line the hole. This is accomplished with a reinforced rib 38 which protrudes from the portion 20 and nestles inside the "C"-shape (FIG. 3). The upper transition area 36 between the press-fit section 18 and the second contact portion 22, similarly, must not affect the force characteristics of the press-fit section, and also must be strong enough to withstand a portion of the bending moment due to cantilevered movement of portion 22. This is also accomplished with a reinforced rib 40 which protrudes from the portion 22 and nestles inside the "C"-shape (FIG. 3).

The following general example illustrates a press-fit section constructed according to this invention for a range of holes from a minimum hole (0.036") to a maximum hole (0.046"), i.e., for holes having a nominal size of 0.041" and permitted tolerance of ±0.005".

EXAMPLE

A press-fit section for engaging holes within a range of from 0.036" to 0.46" diameter and constructed according to this invention comprises an open, curved or arcuate segment, generally resembling a "C"-shape. The "C"-shape extends through an angle of about 225°. The length L of the "C"-shape is thus approximately 0.080". The diameter d of the "C"-shape is approximately 0.052". The thickness T of the "C"-shape is approximately 0.014". The ratio of the thickness T to the length L of the "C"-shape is therefore about 0.175. The ratio of the thickness T to the diameter d of the "C"-shape is therefore about 0.269. The material making up the "C"-shape is Phosphor Bronze Grade C, plated with gold over nickel. Premilled stock is used as an alternative to coining.

This configuration enables the press-fit section to operate in the wide range of plated-through hole sizes (0.036" to 0.046"). The pin provides sufficient retention forces in the maximum hole without causing excessive damage in the minimum hole. The first approximately 0.003" of diametral displacement or compression is essentially elastic, and the displacement beyond this is essentially plastic. In the approximately 0.005" of displacement upon insertion into a maximum hole, sufficient force results to give proper retention in the maximum hole. In the successive 0.010 displacement, upon insertion into a minimum hole, the force build-up due to the additional compression is minimal. This permits use of the same pin in the minimum hole without causing excessive damage to the integrity of the hole or rupturing the conductive material which may line the hole.

The radial force exerted by this press-fit section when at rest in a plated-through hole of a 0.125" G-10 board is at least 30 pounds in a maximum hole and yet, does not exceed 80 pounds when at rest in a nominal or minimum plated-through hole. The value of the push-out force for removal of the press-fit section from any of the specified holes is at least 8 pounds.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. In electrical connection apparatus including a mounting board having a plurality of spaced holes of a wide range of sizes therein and a plurality of contact pins adapted to be partially contained in said board holes, the improvement comprising each of said contact pins having a press-fit section comprising, in cross-section, a curved or arcuate, generally "C"-shaped segment having smooth, continuous inner and outer curved surfaces and which remains open in that the end portions of such "C"-shaped segment do not abut one another and have a freedom of movement both before and after said press-fit section is inserted into said holes, said press-fit section being dimensioned and formed of a material whereby said press-fit section undergoes plastic deformation in a substantial portion thereof upon insertion into any one of said wide range of holes.

2. Electrical connection apparatus as in claim 1 wherein said "C"-shaped segment has a substantially uniform thickness.

3. Electrical connection apparatus as in claim 1 wherein said press-fit section exerts a radial force on said board of a least 30 pounds but not greater than 80 pounds when at rest in any one of said wide range of holes.

4. Electrical connection apparatus as in claim 1 wherein removal of said press-fit section from any one of said wide range of holes into which said press-fit section has been inserted requires a push-out force of at least 1 pound.

5. Electrical connection apparatus of claim 4 wherein said required push-out force is greater than 8 pounds.

6. Electrical connection apparatus as in claim 1 wherein said holes have diameters of from 0.036" to 0.046".

7. Connector apparatus for use with mounting board assemblies having a wide range of holes comprises a pin having a press-fit section comprising, in cross-section, a curved or arcuate, generally "C"-shaped, segment having smooth, continuous inner and outer curved surfaces and which remains open in that the end portions of such "C"-shaped segment do not abut one another and have a freedom of movement both before and after said press-fit section is inserted into such openings in such mounting board assemblies, said press-fit section being dimensioned and formed of a material whereby said press-fit section undergoes plastic deformation in a substantial portion thereof upon insertion into any one of such wide range of holes.

8. Connector apparatus as in claim 7 wherein said "C"-shaped segment has a substantially uniform thickness.

9. Connector apparatus as in claim 7 wherein said "C"-shaped segment has a thickness to length ratio of greater than 1:9.

10. Connector apparatus as in claim 7 wherein said "C"-shaped segment has a thickness to diameter ratio greater than 1:5.

11. Connector apparatus as in claim 7 wherein said material has a high initial stiffness such that said "C"-shaped segment will undergo such plastic deformation in a substantial portion thereof upon minimum displacement required for insertion into a maximum hole and said material is able to withstand severe plastic deformation upon undergoing maximum displacement required for insertion into a minimum hole without approaching failure stress.

12. The connector apparatus of claim 11 wherein said material is phosphor bronze.

13. Connector apparatus comprises a pin having a press-fit section comprising, in cross-section, an open, curved or arcuate, generally "C"-shaped, segment having a substantially uniform thickness, said "C"-shaped segment having a thickness to length ratio of greater than 1:9 and a thickness to diameter ratio of greater than 1:5 and, said "C"-shaped segment being composed of phosphor bronze whereby said press-fit section undergoes plastic deformation in a substantial portion thereof upon minimum displacement.

14. An improved electrical connection apparatus comprising an electrical connector pin having a press-fit section, and a mounting board provided with holes therein being of a wide range of sizes and of smaller lateral dimension than said press-fit section, said press-fit section being adapted for press-fit engagement in any one of said holes and including a curved or arcuate generally "C"-shaped cross-sectional segment adapted to engage said mounting board and be deformed thereby upon insertion of said segment into a mounting board hole, said segment having smooth, continuous inner and outer curved surfaces and terminating at opposed end portions which are separated from one another and remain so separated in that said end portions do not abut one another upon insertion of said segment into one of said mounting board holes, said segment being formed of a material and having a cross-sectional length, thickness and outer dimension to effect inelastic deflection of said segment upon forcible insertion of said segment into mounting board holes of sizes substantially throughout said range of hole sizes whereby said connector pin will be securely and positively retained within any one of said mounting board holes without damaging said board.

15. Electrical connection apparatus as in claim 14 wherein said "C"-shaped segment has a substantially uniform thickness.

16. Electrical connection apparatus as in claim 15 wherein said press-fit section exerts a radial force on said board of at least 30 pounds but not greater than 80 pounds when at rest in any one of said wide range of holes.

17. Electrical connection apparatus as in claim 16 wherein removal of said press-fit section from any one of said wide range of holes into which said press-fit section has been inserted requires a push-out force of at least one pound.

18. Electrical connection apparatus as in claim 17 wherein said required push-out force is greater than eight pounds.

19. Electrical connection apparatus as in claim 15 wherein said holes have diameters of from 0.036" to 0.046".

20. A connector pin for press-fit engagement in a hole of a mounting board assembly having holes of a wide range of sizes, the improvement comprising said pin having a press-fit section which is of a curved or arcuate, generally "C"-shaped cross-section and having smooth, continuous inner and outer curved surfaces and which remains open in that the end portions of such "C"-shaped cross-section do not abut one another and have a freedom of movement both before and after said press-fit section is inserted into such holes in such mounting board assembly, said press-fit section having a pre-insertion outer lateral dimension of about 0.052 inches, a thickness to lateral dimension ratio of at least 1:5, and of a material such that upon insertion of said segment into any one of said mounting board holes substantially throughout said range of hole sizes, it is inelastically deflected, thereby effecting secure retention in any one of such holes without damaging such board.

21. Connector pin as in claim 20 wherein said "C"-shaped cross-section has a substantially uniform thickness.

22. Connector pin as in claim 21 wherein said "C"-shaped cross-section has a thickness to length ratio of greater than 1:9.

23. Connector pin as in claim 21 wherein said material has a high initial stiffness such that said "C"-shaped cross-section will undergo such inelastic deflection in a substantial portion thereof upon minimum displacement required for insertion into a maximum hole and said material is able to withstand severe inelastic deflection upon undergoing maximum displacement required for insertion into a minimum hole without approaching failure stress.

24. The connector pin of claim 23 wherein said material is phosphor bronze.

* * * * *

UNITED STATES PATENT AND TRADEMARK OFFICE

CERTIFICATE OF CORRECTION

PATENT NO. : 4,183,610

DATED : January 15, 1980

INVENTOR(S) : Edward H. Key

It is certified that error appears in the above-identified patent and that said Letters Patent are hereby corrected as shown below:

Column 6, line 4, "0.46" should read -- .046 --.

Column 7 (Claim 3), line 6, "a" should read -- at --.

Signed and Sealed this

*Third* Day of *June 1980*

[SEAL]

*Attest:*

SIDNEY A. DIAMOND

*Attesting Officer*

*Commissioner of Patents and Trademarks*